US006097585A

United States Patent [19]

Heinzelmann et al.

[11] Patent Number: 6,097,585

[45] Date of Patent: Aug. 1, 2000

[54] METHOD AND DEVICE FOR DRIVING AN ELECTROMAGNETIC CONSUMER

[75] Inventors: Michael Heinzelmann, Fellbach; Ole See, Gerlingen; Joern Beckmann, Hemmingen; Jost Krauss, Ditzingen, all of Germany

[73] Assignee: Robert Bosch GmbH, Stuttgart, Germany

[21] Appl. No.: 09/191,053

[22] Filed: Nov. 12, 1998

[30] Foreign Application Priority Data

Nov. 12, 1997 [DE] Germany ..... 197 50 027

[51] Int. Cl.[7] ..... H01F 7/18

[52] U.S. Cl. ..... 361/160; 361/154

[58] Field of Search ..... 361/152, 156–160

[56] References Cited

U.S. PATENT DOCUMENTS 5,835,330 11/1998 Kirschner et al. ..... 361/152

*Primary Examiner*—Fritz Fleming
*Attorney, Agent, or Firm*—Kenyon & Kenyon

[57] ABSTRACT

A method and device are described for driving an electromagnetic consumer, which includes a movable element. This element includes a solenoid-operated valve for controlling the metering of fuel into an internal combustion engine. A switching instant is determined within a timing window. Within the timing window, the voltage being applied to the consumer is able to be controlled to an adaptable setpoint value in open and/or closed loop.

20 Claims, 2 Drawing Sheets

METHOD AND DEVICE FOR DRIVING AN ELECTROMAGNETIC CONSUMER

FIELD OF THE INVENTION

The present invention relates to a method and device for driving an electromagnetic consumer.

BACKGROUND INFORMATION

German Patent Application No. DE 44 20 282 describes a method and device for driving an electromagnetic consumer which includes a movable element. The consumer is a solenoid-operated valve for controlling the metering of fuel into an internal combustion engine. A switching instant when the movable element changes its position is determined within a timing window. This is achieved by analyzing the time characteristic of a variable that corresponds to the current flowing through the consumer. During the timing window in which the current is analyzed, the voltage being applied to the consumer is controlled to a constant value in closed loop or open loop.

In the cold start-up phase, the leads to the consumer are low-resistance, so that under constant voltage conditions, the currents reach a higher level than in normal operation. If provision is made for a current monitoring to switch off the output stage as of a specific threshold value, this can lead to the output stage being switched off by the current monitoring.

In addition, clear differences are apparent in the resistance of the individual current leads to the individual consumers. Therefore, if the voltage within the timing window is preset to be so low that, under the most unfavorable conditions, the result is that the output stage is not switched off, this can lead, in turn, to such a small current flowing through the consumer during the timing window that the forces acting upon the movable element are not significant enough to retain the element in its position. When working with a solenoid-operated valve, this can lead to a short-term re-opening or re-closing.

SUMMARY OF THE INVENTION

An object of the present invention, for a method and device for driving an electromagnetic consumer, is to specify when the switching instant is determined, a suitable voltage value at which the output stage is not switched off for safety reasons, and at which the valve remains reliably in its position.

The procedure according to the present invention makes it possible to avoid any interruption of the output stage current during detection of the switching instant. The movable element, i.e., the solenoid-valve needle, is retained in its position with the greatest possible force. A re-opening or re-closing of the solenoid valve is avoided. In addition, differences in the electrical resistance in leads to the solenoid valve are compensated.

DETAILED DESCRIPTION

The present invention will be described in the following based on the example of a consumer. The consumer includes a movable element. The consumer is, in particular, a solenoid valve for controlling the fuel being metered into an internal combustion engine. In the case of a solenoid valve, the movable element is referred to as a valve needle.

Figure 1:
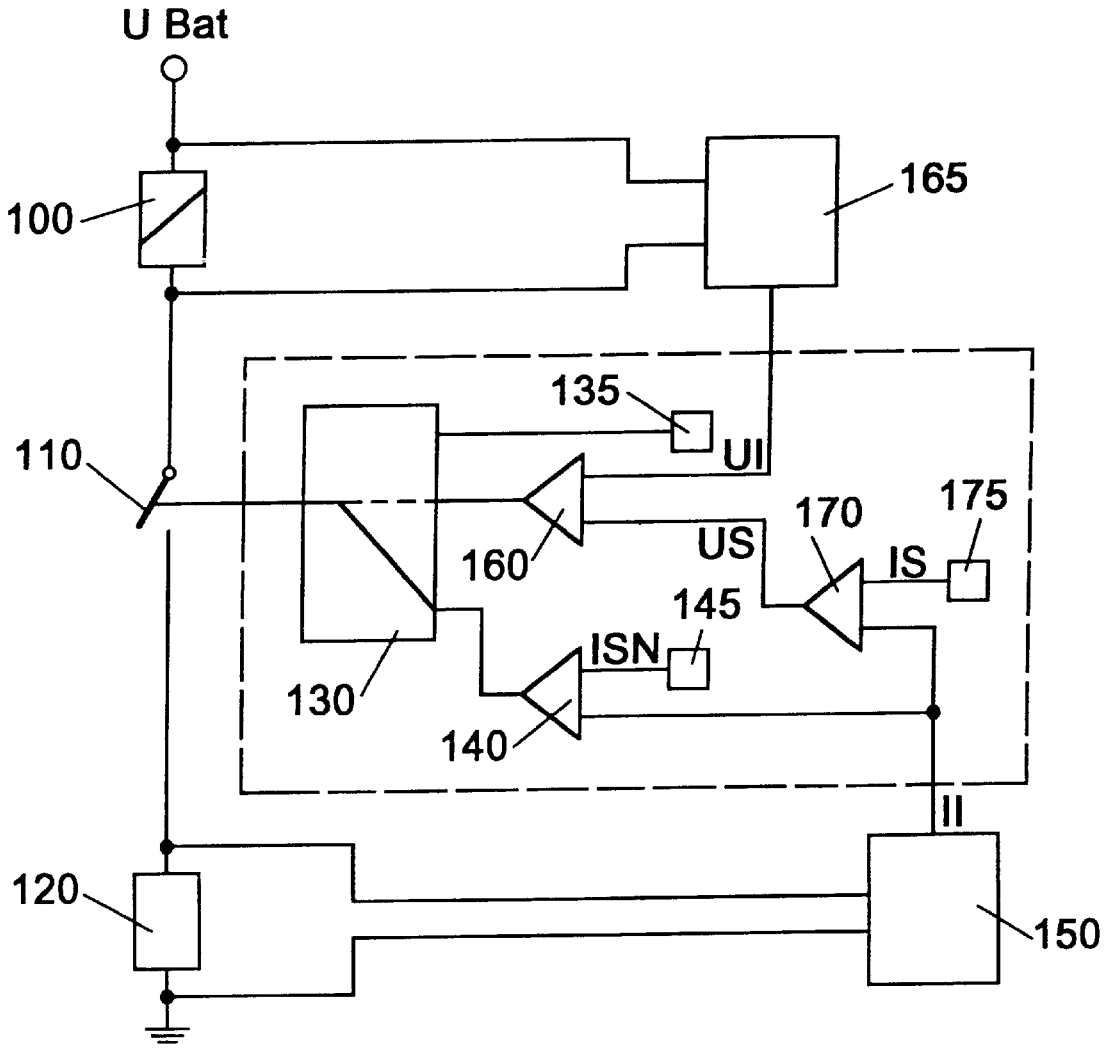
FIG. 1 shows a schematic representation of an output stage.

The device of the present invention is depicted in FIG. 1 on the basis of a block diagram. A consumer 100 is linked via its first terminal to a supply voltage $U_{bat}$. The second terminal of consumer 100 is connected to the first terminal of a switching element 110. The second terminal of switching element 110 is linked to a first terminal of a current-measuring means 120. The second terminal of current-measuring means 120 is connected to ground.

In the depicted exemplary embodiment, consumer 100, switching element 110 and current-measuring means 120 are connected in series in this sequence. This sequence is only selected by way of example. A different sequence of the three elements is possible as well. Thus, switching element 110 can also be configured between the supply voltage and the consumer. Furthermore, current-measuring means 120 can also be arranged between the switching means and the consumer, or between the consumer and the supply voltage.

Switching element 110 is preferably implemented as a transistor, in particular as a field-effect transistor. Current-measuring means 120 is preferably designed as an ohmic resistor. Consumer 100 is preferably the coil of a solenoid valve that is used for metering fuel.

Control terminal of switching means 110 is linked to a change-over switch 130. The change-over switch optionally switches the output signal from a current controller 140 or the output signal from a voltage regulator 160 to the control terminal of the switching means. The switch-over is made as a function of a control 135.

As setpoint value ISN, current controller 140 is fed the output signal from a setpoint entry 145 and, as actual value II, the output signal from a current detection unit 150. In addition, the output signal from current detection unit 150 arrives at a second current controller 170, which, in addition, processes actual value IS from a second setpoint entry 175.

The second current controller 170 applies a setpoint value US to voltage regulator 160. Actual value UI of voltage regulator 160 is made available by a voltage detection unit 165.

Voltage detection unit 165 is linked to the first and second terminal of the consumer. Current detection unit 150 is linked to the first and second terminal of current-measuring means 120.

The functioning of this device is as follows. In normal operation, change-over switch 130 occupies the position shown with a solid line. The result is that the first current controller 140 is active, and the switching means is driven along the lines of a current control in closed-loop.

Current I, which flows through consumer 100, is detected by current-measuring means 120 and current detection unit 150. The fourth setpoint entry 145 specifies a setpoint value ISN. Setpoint value ISN and actual value II are compared and, as a function of this comparison, first current controller 140 specifies a driving signal to be applied to switching means 110.

This means that current II, which flows through the consumer, is controlled to a predefined setpoint value ISN in closed loop.

If the consumer is driven, for example, to force the valve needle of a solenoid valve into a new position, then value ISN is set at the beginning of the driving (activation) to a high value, a so-called initial pickup value. If the valve needle reaches its new position, then the current is set to a low value, a so-called hold-current value. This selection of the setpoint value ISN is carried out in the first setpoint entry 145 as a function of various signals, in particular operating parameters (not shown) of the internal combustion engine where the consumer is installed.

To determine the switching instant when the valve needle reaches a specific position, the transition is usually made from a current control to a voltage closed-loop control and/or to a voltage open-loop control during a timing window in which the switching instant probably occurs.

The timing window is defined by two instants. These are the beginning and the end of the timing window. The beginning of the timing window is defined, for example, by a fixed or predefinable time duration starting from the beginning of the driving (activation). The end of the timing window is defined, for example, by a fixed or predefinable time duration starting from the beginning of the timing window.

If the timing window within which the switching instant probably occurs is reached, then control 135 switches change-over switch 130 into the position shown with a dotted line. This means voltage regulator 160 is active in the timing window. Voltage regulator 160 compares voltage UI, which is being applied to the consumer and which is made available to voltage detection unit 165 to a setpoint value US. On the basis of this comparison, controller 160 activates switching means 110 accordingly.

During the timing window, the switching instant is determined by evaluating the time characteristic of a variable, which corresponds to the current flowing through the consumer. Usually, the switching instant is recognized when the current characteristic shows a bend over time.

Provision can also be made in a simplified exemplary embodiment for merely an open-loop control to take place whereby the driving signal for switching means 110 is essentially predefined as a function of setpoint value US.

To retain solenoid-valve needle in its position, while it is traversed by current, in the timing window using the maximum force possible, without an overcurrent interruption (cut-out) taking place, setpoint value US is predefined for the voltage by a second current controller 170. For this, a second setpoint entry 175 defines a setpoint value IS for the current during the timing window, which is selected so as to enable the solenoid valve needle to be retained in its position while traversed by current, using the maximum force possible, without an overcurrent interruption occurring.

This setpoint value is compared to current II measured during the timing window and, as a function of this current comparison, a setpoint value US is predefined for voltage regulator 160. Actual value II is preferably measured in the range of the switching instant. The actual value is measured shortly before, during, or shortly after the switching instant. It is particularly advantageous when a weighted average current value for each solenoid valve is used as an actual value.

The means that the voltage to which the control is performed in closed loop or open loop during the timing window is adaptively adjusted for each solenoid valve. This closed-loop control is performed by measuring the current for each consumer. This current value is brought up to an applicable setpoint current value by controller 170, preferably an integral-action controller.

In addition, the maximum current, which must not exceed an applicable threshold, is observed during the timing window.

It is especially advantageous when the voltage to which the control is performed in closed-loop during the timing window is made up of a reference value, which is predefinable as a function of the battery voltage, and of an offset value. In this context, the offset value is determined by controller 170. This makes it possible to avoid oscillations in the closed-loop control circuit. Thus, for example, given a battery that is briefly subjected to a heavy load, the I-integral-action component of the controller is raised too sharply. This would lead, in turn, when load is subsequently removed from the battery, to the current being interrupted (i.e., cut-off).

Figure 2:
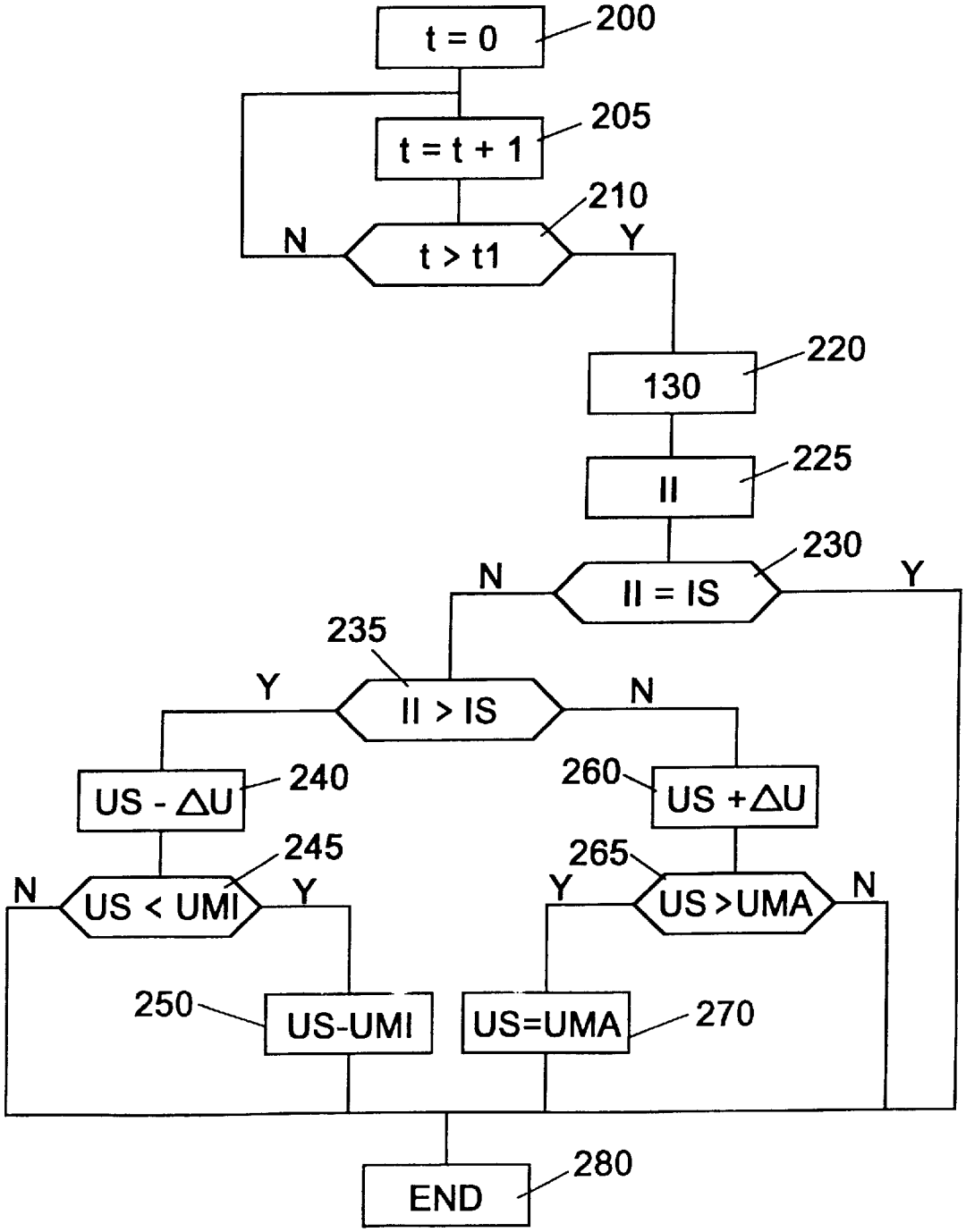
FIG. 2 shows a flow chart illustrating a procedure according to the present invention.

FIG. 2 shows an especially advantageous exemplary embodiment of the present invention on the basis of a flow chart. At the beginning of an injection, a time meter t is set to 0 in step 200. In step 205, time meter t is raised by one. Subsequent query 210 checks whether time meter t is greater than a threshold value t1. If this is not the case, then step 205 follows once more. If time meter t is at a value greater than threshold value t1, then step 220 follows.

Threshold value ti corresponds to the lower value of the timing window, within which the injection probably occurs. This time threshold value ti is preferably defined as a function of at least the switching instant of the preceding injection and of other operating parameters.

If the timing window is reached, then change-over switch 130 is driven in step 220 by control 135 to effect the transition from a current control to a voltage control. In subsequent step 225, the actual value II for the current is measured. Using the active current value as actual value II at the switching instant is especially beneficial.

Subsequent query 230 checks whether actual value II is equal to setpoint value IS, which is predefined by the second setpoint value entry 175. If this is the case, then the program ends in step 280. If this is not the case, then query 235 checks whether the actual value is greater than the setpoint value. If this is the case, then in step 240, the setpoint value and the voltage US are reduced by the value AU. A query 245 then follows to check whether setpoint value US is smaller than a lower threshold value UMI. If this is not the case, the program ends in step 280. If the value is smaller than the lower threshold value, then setpoint value US is set to value UMI in step 250.

If query 235 recognizes that the actual value is not greater than setpoint value IS, then the value US for the voltage is increased by value $\Delta U$ in step 260. Subsequent query 265 checks whether setpoint value US for the voltage is greater than an upper threshold value UMA. If this is the case, then setpoint value US for the voltage is set to value UMA. If the threshold value is not greater than upper threshold value UMA, the program likewise ends in step 280.

Queries 245, 260 and steps 250 and 270 limit the voltage to lower and upper maximum values.

What is claimed is:

1. A method for driving an electromagnetic consumer, the electromagnetic consumer including a movable element, comprising the steps of:

determining a switching instant, when the movable element reaches a predetermined position, within a timing window; and within the timing window, controlling a voltage to an adaptable setpoint value in at least one of an open loop and a closed loop, wherein the voltage is applied to the electromagnetic consumer.

2. The method according to claim 1, wherein the movable element includes a solenoid-operated valve controlling a metering of a fuel into an internal combustion engine.

3. The method according to claim 1, further comprising the step of:

determining the adaptable setpoint value as a function of a current controller.

4. The method according to claim 3, further comprising the step of:

adjusting an actual value of a current during the timing window to a predefined value using the current controller.

5. The method according to claim 4, further comprising the step of:

determining the actual value of the current at a time that substantially corresponds to the switching instant.

6. The method according to claim 1, wherein the setpoint value is limited to maximum values.

7. The method according to claim 1, wherein the determining step includes the substep of:

analyzing a time characteristic of a variable which corresponds to a current flowing through the electromagnetic consumer.

8. The method according to claim 1, wherein the step of controlling a voltage to an adaptable setpoint value includes the steps of:

determining an actual current;

comparing the actual current and a current setpoint, and providing a first comparison result; and adjusting the adaptable setpoint value based on the first comparison result to provide an adjusted adaptable setpoint value.

9. The method according to claim 8, further comprising the steps of:

comparing the adjusted adaptable setpoint value to at least one of a first threshold and a second threshold, and providing at least a second comparison result; and setting the adjusted adaptable setpoint value to one of the first threshold and the second threshold based on the at least a second comparison result.

10. The method according to claim 9, wherein the first threshold is a lower threshold and the second threshold is an upper threshold.

11. The method according to claim 8, wherein the actual current is determined about the same time as the switching instant.

12. The method according to claim 8, wherein the actual current is a weighted average current.

13. The method according to claim 8, wherein the actual current is determined within the timing window.

14. The method according to claim 8, wherein the current setpoint enables a solenoid valve needle to be retained in a position while traversed by a current.

15. The method according to claim 14, wherein an overcurrent interrupt condition does not occur.

16. A device for driving an electromagnetic consumer, the electromagnetic consumer including a movable element, the device comprising:

an arrangement determining a switching instant when the movable element reaches a predetermined position within a timing window; and a control arrangement controlling a voltage to an adaptable setpoint value in at least one of an open loop and a closed loop, wherein the voltage is controlled within the timing window and is applied to the electromagnetic consumer.

17. The device according to claim 16, wherein the movable element includes a solenoid-operated valve controlling a metering of a fuel into an internal combustion engine.

18. The device according to claim 16, wherein the control arrangement includes a controller that controls the voltage to an adaptable setpoint value based on an actual current and a current setpoint.

19. The device according to claim 18, wherein the actual current is determined about the same time as the switching instant.

20. The device according to claim 18, wherein the current setpoint enables a solenoid valve needle to be retained in a position while traversed by a current so that an overcurrent condition does not occur.

* * * * *

UNITED STATES PATENT AND TRADEMARK OFFICE

CERTIFICATE OF CORRECTION

PATENT NO. : 6,097,585

DATED : August 1, 2000

INVENTOR(S) : Michael Heinzelmann, et al.

It is certified that error appears in the above-indentified patent and that said Letters Patent is hereby corrected as shown below:

Column 4, line 21, change "... ti..." to --... t1... --.

Column 4, line 23, change "... ti..." to --... t1... --.

Signed and Sealed this

Eighth Day of May, 2001

*Attest:*

Nicholas P. Godici

NICHOLAS P. GODICI

*Attesting Officer*

*Acting Director of the United States Patent and Trademark Office*